US009078537B2

(12) United States Patent
Lee

(10) Patent No.: US 9,078,537 B2
(45) Date of Patent: Jul. 14, 2015

(54) SINGLE CORDLESS CONTROL FOR WINDOW COVERING

(71) Applicant: Han-Sen Lee, Chang-Hwa Hsien (TW)

(72) Inventor: Han-Sen Lee, Chang-Hwa Hsien (TW)

( * ) Notice: Subject to any disclaimer, the term of this patent is extended or adjusted under 35 U.S.C. 154(b) by 90 days.

(21) Appl. No.: 13/911,071

(22) Filed: Jun. 5, 2013

(65) Prior Publication Data

US 2014/0360682 A1 Dec. 11, 2014

(51) Int. Cl.

| | |
|---|---|
| ***E06B 9/30*** | (2006.01) |
| ***A47H 5/032*** | (2006.01) |
| *E06B 9/384* | (2006.01) |

(52) U.S. Cl.

CPC . *A47H 5/032* (2013.01); *E06B 9/30* (2013.01); *E06B 9/384* (2013.01)

(58) Field of Classification Search

USPC .... 160/168.1 R, 170, 176.1 R, 173 R, 177 R, 160/178.3

IPC ..... E06B 9/384,9/30

See application file for complete search history.

(56) References Cited

U.S. PATENT DOCUMENTS

| | | | | |
|---|---|---|---|---|
| 2,276,716 | A * | 3/1942 | Cardona | 160/170 |
| 2,737,235 | A * | 3/1956 | Hediger | 160/170 |
| 2,758,644 | A * | 8/1956 | Virlouvet | 160/170 |
| 3,141,497 | A * | 7/1964 | Griesser | 160/170 |
| 3,260,302 | A * | 7/1966 | Griesser | 160/170 |
| 3,352,349 | A * | 11/1967 | Hennequin | 160/171 |
| 4,200,135 | A * | 4/1980 | Hennequin | 160/168.1 R |
| 4,697,630 | A * | 10/1987 | Rude | 160/177 R |
| 5,123,472 | A * | 6/1992 | Nagashima et al. | 160/170 |
| 5,228,491 | A * | 7/1993 | Rude et al. | 160/171 |
| 5,628,356 | A * | 5/1997 | Marocco | 160/170 |
| 5,664,614 | A * | 9/1997 | Debs | 160/168.1 R |
| 5,725,040 | A * | 3/1998 | Domel | 160/170 |
| 5,743,319 | A * | 4/1998 | Christopherson | 160/173 R |
| 5,918,657 | A * | 7/1999 | Tuzmen | 160/168.1 R |
| 6,116,323 | A * | 9/2000 | Huang | 160/170 |
| 7,137,430 | B2 * | 11/2006 | Fraczek | 160/170 |
| 7,287,569 | B2 * | 10/2007 | Lin | 160/170 |
| 7,520,310 | B2 * | 4/2009 | Colosio | 160/168.1 R |
| 8,267,145 | B2 * | 9/2012 | Fraser et al. | 160/115 |
| 2005/0056383 | A1 * | 3/2005 | Huang | 160/170 |
| 2011/0253321 | A1 * | 10/2011 | Yu et al. | 160/170 |

* cited by examiner

*Primary Examiner* — David Purol

(74) *Attorney, Agent, or Firm* — Curtis L. Harrington; Harrington & Harrington

(57) ABSTRACT

A single control input is realized with the use of a combination slat angle adjustment and window covering opening lift set structure which may be operated by a single wand. A three segment relative control logic is realized which includes movement within in the middle segment that controls the angle of the slats, and movement to and beyond the position where the slats are maximally angled in one direction results in at least one of opening (raising) or closing (lowering) of the slat set by "winding up" a lift cord set which may operate on the interior or exterior of the slat set.

18 Claims, 7 Drawing Sheets

SINGLE CORDLESS CONTROL FOR WINDOW COVERING

FIELD OF THE INVENTION

The present invention relates to a mechanism and process for providing actuation of a single control in order to raise and lower window covering blind sets, as well as to control the angle of tilt of window covering blind sets. The structure and method enables elimination of user actuatable dangling cords and further pe nits simplification and mass automation of control and operation of a window covering blinds set to enhance safety.

BACKGROUND OF THE INVENTION

Conventional window coverings which use a series of horizontally disposed, vertically arranged slats are available in a variety of styles. The typical structure for supporting the slats vertically spaced from each other includes an end ladder arrangement having a series of cross connectors upon which the slats rest. In the 1950's the ladder arrangement included a wide tape and the cross connectors included a series of generally horizontal tape sections joining the a front and rear vertical ladder tape. Movement of the front vertical ladder tape with respect to the rear vertical ladder tape caused a tilting of the horizontal tape section and consequent tilting of the supported louver or slat resting on the horizontal tape section.

The initial use of a soft vertical ladder tape enabled the lowest base louver or slat to be raised while sequentially collecting slats against the rising lowest base louver while enabling collapse of each vertical ladder tape section between adjacent horizontal tape sections as slats were collected together against the base slat. As the base slat was raised to its uppermost position, the slats would be collected into a closely adjacent group nearest an upper head rail which typically provided fittings for operating the window covering blinds set. Control of the operation of the window covering blinds set typically involved a lift cord for raising the base slat and collecting the slats in a group just underneath the head rail to place the window covering blinds set in a lifted, open position, and a tilt control used to raise or lower the front vertical ladder tape with respect to the rear vertical ladder tape to cause a tilting of the horizontal tape section to control the angle of tilt of the supported louvers resting on the horizontal tape sections.

Traditionally, two collections of cords were used to enable control of the lift control for opening the window covering blinds set and the tilt control, respectively. Tilt control was typically achieved by pulling one side of a looped cord to cause the front vertical ladder tape with respect to the rear vertical ladder tape with direct visual feedback. The lift control was achieved typically by pulling a pair of joined or length coordinated cords from one side of the head rail so that each side of base slat would be lifted evenly. Without length coordination of the lift cords, one side of the base slat would begin to raise higher than the other. Often the coordination was done with a metal slip buckle.

In the early days, the pair of cords which raised and lowered the blinds were a loop at the bottom, with the loop being lowered as the window covering set was raised, and raised as the window covering set was lowered. Children were known to play with the end of the lift cord, and the lower end of the lift cord was even more available when the window covering set was raised. Children were also known to accidentally become caught in the lower loop. In some cases choking can occur.

Other structures were recently employed to keep lift cords joined, including placing the coordination between the cords high and near the head rail. The head rail is a metal structure which may be high up and near a metal rail which provides support for the window covering as well as actuation hardware. This arrangement works less well with vertically tall window covering sets because the raising of the slat set puts even more loose cord at or near the ground. Further, where the window covering set was particularly vertically high, the user might find the uppermost starting position of the coordinated cords to be inaccessible.

In another configuration, the lift cords were separated into individual cord members and secured within a cord safety connector which is used to both tension, secure, collect and enable tension pulling and actuation either by grasping the safety connector or optionally by grasping a single cord which extends from the bottom of the safety connector. A safety connector acts to keep the cords coordinated if operated by direct manual grasping and actuation of the safety connector, or by a cord extending below it, but will break apart if an object enters between two cords and bears down upon the safety connector. Safety connectors which completely separate and leave only single dangling cords which are generally incapable of causing a choking or strangling hazard.

In the earliest window coverings, the control of the tilt of the louvers or slats was accomplished by using a pair of opposed cords. Unlike the lift cords which were better to be coordinated, the tilt cords were intended to work oppositely. When one cord is pulled, the other cord retracts, and vice versa. In some of the earlier window coverings an operable loop was possible, but it was generally preferred to have a pair of cords, each having its own terminus, especially also to distinguish it from the coordinated lift cord. The tilt mechanism basically consisted of the turning of a drum over one ladder tape set and which may have a shaft to transmit turning to a second and or subsequent ladder sets.

In view of the foregoing, the area inside the head rail had two sets of distributive controls. Taken from the upper front of a head rail and looking to the right, a double or triple or quadruple coordinated cord set would enter into the head rail and each would be distributed to locations directly over the ladder tape or ladder cord, extend through apertures in the head rail and then typically through individual slat apertures in the lateral centers of the slats and finally to some fixed position on the bottom slat. As the lift cords were taken in toward the head rail, the bottom fixed slat would rise to collect the other slats near the underside of the head rail.

Some window coverings have "rootless" or "no-holes" slat sets which either route the lift cord through some structure located to a rear side of the slat, or which may use a pair of guided lift cords which are held relatively closely to the ladder cord matrix. The so-called "routless" feature was developed primarily to eliminate the aperture from the center of the slats. In other slat sets, a center aperture is set to be of a diameter for fitting closely around a lift cord. Window covering sets which are "routless" generally still typically use a lift cord set which can come into contact near the floor and create a danger for children and pets.

At the other end of the head rail, the pair of tilt cords would operate a drum to cause the raising or lowering of the front vertical ladder tape or member with respect to the rear vertical ladder tape or member to cause a tilting of the horizontal tape section to control the angle of tilt of the supported slats resting on the horizontal tape or horizontal ladder cord sections. In later models of the window coverings, a wand was provided with a reduction gear so that a user could easily manipulate the wand by turning it with fingers to cause the raising or lowering of the front vertical ladder member with respect to the rear vertical ladder member to cause tilting of the horizontal ladder section to control the angle of tilt of the supported slats as previously described. However there has been no effective substitute for the operation of the lift cord sets.

In the traditional slat window covering, tilt was able to occur independently of lift. Although with some friction, the slats could be lifted while they were in a forward, rearward or neutral tilt angle. Likewise, a tilt adjustment could occur regardless of whether the slat set was fully extended or closed, whether it was half way open, or whether it was at the full open position. Exact simultaneous activation is not an overriding advantage, but the main objective is safety and elimination of the lift cord set has been viewed as the major objective in making window covering slats safer.

Even in conventional manually operated window covering sets, the concern over safety is so high that even those structures with hanging slat lift cords often have stops mounted on the manually operable lift cords near the points of entry into the head rail and that will prevent children and pets from "fishing out" any appreciable extra length of lift slat cord from in between any two adjacent slats, as such pick might form a potentially dangerous loop. Slat angle adjustment cords have separate ends an are typically short and located near the top of the window covering blind set which makes it a solution which is limited by the height of the blind set. Elimination of the ability to tamper with the window covering blind set so as to form a dangerous loop is a high priority.

What is needed is a window covering slat set which can be manually or electrically actuated and having a control input which eliminates as much as possible any potential for unwanted, dangerous entanglement with humans. The needed solution should eliminate all dangling control cords extending from the head rail. The needed solution should permit a slat-type window covering to be opened and closed and have the angle of tilt of the slats adjusted regardless of the degree to which the slat set is raised.

SUMMARY OF THE INVENTION

A novel and nonobvious structure and method for operation of a window covering set, and which permits actuation, manually or by machine, of a single control, is disclosed. The single control structure may preferably be a single wand, with or without a lower angled member and fitting to facilitate cranking, or it may be used as an interface for a single motorized and preferably controllable driver to enable complete control of the lift and slat tilt functions through a single mechanical interface.

Control is had by creating a three segment relative control logic. The three segment relative control logic can be visualized by a contiguous segments where movement within in the middle segment controls the angle of the slats, and movement to and beyond the position where the slats are maximally angled in one direction results in at least one of opening (raising) or closing (lowering) of the slat set by "winding up" a lift cord set which may operate on the interior or exterior of the slat set.

If the raising of the window covering slat set is in progress and the control input is reversed, the slat angle will begin to change from the one angular extreme it assumed when it began to be lifted, and once the angle reaches the other angular extreme, continued control input will cause the slat set to begin to be lowered. Likewise where the lowering of the window covering slat set is in progress and the control input is reversed, the slat angle will begin to change from the other angular extreme at which it was raised and back to the one angular extreme which was previously associated with lowering and further continued control input will cause the slat set to again be raised.

When the slat set is closed and in a position where the window covering is at its maximum lowered extent and covering the window opening, a control input in one direction will change the slat angle to one extreme, and thereafter continued control input in that direction will result in raising of the slat set. But also, when the slat set is closed and in a position where the window covering is at its maximum lowered extent and covering the window opening, a control input in the other direction will change the slat angle to the other extreme, and thereafter continued control input in that direction will also result in raising of the slat set. In essence, spools which have the capability to take up the lift cords can be actuated in either direction onto the spool. As before, during lifting or lowering, a change in rotational input will halt such lifting or lowering and begin to control the angle of the slats.

Slat angle can be adjusted while the window covering is located at any position between fully lowered and fully raised. Any control input that is applied which goes beyond either of two extremes in angling the slats will begin or continue lifting or lowering of the slat set. A coordinating mechanical rod may be arranged to extend the length of the head rail to mechanically connect and coordinate multiple combination slat angle adjustment and window covering opening lift sets, especially for long slats and wide window covering slat sets. In this fashion, very wide horizontal slat window covering sets having long head rails can simultaneously coordinate multiple combination angle adjustment and lift sets for adequately and evenly supporting long slats so that coordinated and even degrees of light blockage will occur at all adjustment settings.

The ability to raise, lower, and adjust the slat angle of a window covering slat set using a single mechanical input which is simple enough to have only two logic inputs, either a turning motion in one direction or the other direction enables the elimination of control cords and allows a single wand to complete all of the standard slat window covering adjustments. The single mechanical input can be operated with the turning of a manual wand or more automatically and remotely with a simple bi-directional motor. Either the manual or electrically driven embodiments enable complete elimination of manually grasped lift cords which must be pulled down by the user, as well as complete elimination of manually grasped slat angle adjustment cords.

The invention herein is applicable to use both with a central lift cord which extends through apertures in the blind slats as well as the case of a pair of cords which lift from the outside. The manner and details of operation of a pair of outside lift cords may vary widely. Generally is desired that the lift cord remain fairly close to the structure which forms the ladder which both supports and enables the slats to tilt. As before, it is desired that the lift cord not be enabled to be "picked" from any structure so as to enable children and pets to extract a significant sized loop from the ladder.

Because the ladder structure and its relationship with the lift cord can have a number of realizations, all possible combinations should be considered in conjunction with the invention. The lift cord should be able to lift the bottom slat and allow the ladder structure to collapse to enable all lower slats to be stackably collected closely atop a growing bottom stack as the combination slat angle adjustment and window covering opening lift set is opened. The slat lift cords should be able to slidably translate with respect to the slat ladder support structure. This slidable translation may occur via a number of possible structures including the use of a ladder with vertical enclosed structures which surround the lift cord, or fittings on the vertical ladder structure which enable the lift cord to slidably translate with respect to the vertical ladder structure, or with loops formed by the same or different material of the vertical ladder structure which closely guide the lift cord and allow it to slidably translate with respect to the vertical ladder structure.

A slip fitting is used within a slat tilt fitting to limit the movement of the slat tilt fitting as at least one take up drum enables the lift function. The limited motion of the slat tilt fitting is sufficient to enable the slats to move through a range of tilt upon actuation. In one embodiment a pair of take up spools is rotatably connected with a central turn axle which may extend generally parallel to a head rail. The lift cord take up drum or drums may be positively rotationally engaged with the central turn axle. Turning of the central turn axle causes the take up drums to begin to wind up the lift cord which causes the bottom slat to be lifted or lowered. A slat tilt fitting is also rotatably operably connected to turn with the central turn axle to a limited extent, but sufficiently to enable the slats to be tilted as desired upon turning of the central turn axle. The ability of the slat tilt fitting to turn with the central turn axle is angularly limited to occur only over the range of angular tilt displacement of the slats.

As an example, consider a window covering slat set utilizing the combination slat angle adjustment and window covering opening lift set of the invention in a completely lowered state with the angle of tilt of the slats being horizontal, with the tilt fitting being at a center of its angular tilt range. If a user begins to input a mechanical turning force into the central turn axle, both the slat tilt fitting and at least one take up drum start to turn. The turning of the slat tilt fitting will turn with the central turn axle because it has not reached the limit of its tilt operation range. The turning of the slat tilt fitting involves both movement front vertical ladder member and the rear vertical ladder member so that significant slat tilt is achieved with a relatively slight movement of the slat tilt fitting.

Continuing with the example, further continued turning of the central turn axle causes the slat tilt fitting to quickly reach its rotational limit which is the limit of tilt of the slats in the direction in which the central turn axle began turning. Once the limit of the slat tilt fitting is reached, continued turning of the central turn axle only causes the take up spool(s) to turn to continue to take up lift cord to cause the bottom slat to be lifted. Considering again the combination slat angle adjustment and window covering opening lift set in its completely lowered state with the angle of tilt of the slats being horizontal, it is clear that enabling the lift cords to have less than one inch of additional length will delay the action of the start of lift of the slats while the angle of tilt is being adjusted. Some of this "play" can be accomplished not only by additional length, but also by providing an attachment which enables delayed engagement of the take up spools after an amount of turning of the central turn axle. Such provision would prevent even a small loop the size of a pencil to be pulled from a section of lift cord whether it is in between or outside of the vertical ladder member. Many mechanical realizations can be implemented that would give nearly a full turn of the central turn axle before the take up spool(s) are positively rotationally engaged with the central turn axle.

In the embodiment illustrated a combination slat angle adjustment and window covering opening lift set is provided as a housing which can be multiply mounted in a head rail. A pair of take up spool are mounted on either side of slat tilt fitting to (1) provide a pair of take up spools which have separation to reduce the potential for tangles in the pair of lift cords as they are doubly taken up, (2) provide a balancing of forces on the pair of take up spools as they wind and lift the lift cords, (3) allow the slat tilt fitting to be positioned directly over the vertical ladder cords to more directly provide the tilt function, and (4) to place the slip fitting of the slat tilt fitting in a controlled, protected space to insure that the carefully pre-selected slip forces can operate freely without binding through contact with other members, including the combination slat angle adjustment and window covering opening lift set housing walls.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
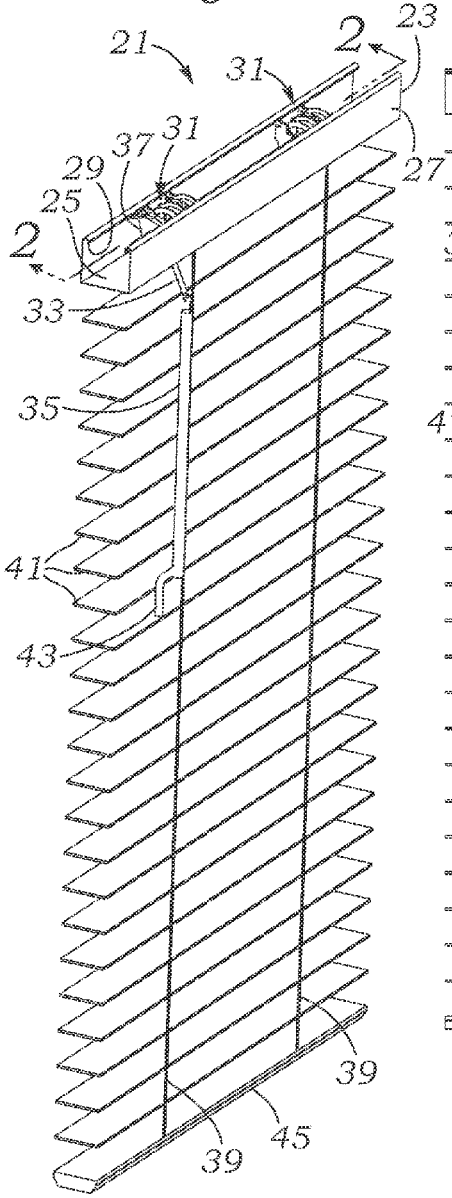
FIG. 1 is a perspective view of a window covering window blind set showing a pair of combination slat angle adjustment and window covering opening lift sets supported within a head rail and having a single control input as a manual wand.

The description and operation of the environment, apparatus and method of the invention will be best described with reference to FIG. 1 which illustrates a perspective view of a window covering window blind set 21 having a head rail 23 having a transverse overall "U" shape and securing a pair of combination slat angle adjustment and window covering opening lift sets 31 which are only partially seen over the top of the head rail 23. Head rail 23 has a base wall 25 and a pair of side walls 27 which have upper portions that terminate in a downwardly directed edge 29. The window covering window blind set 21 is seen as having a single control input fitting 33 which is attached to a manual wand 35. The other end of single control input fitting 33 is attached to a reduction gear 37 which is see just to the left of the leftmost combination slat angle adjustment and window covering opening lift sets 31. Reduction gear may have a turning reduction ratio between 1:2 and 1:8 and may preferably have a turning reduction ratio of about 1:5.

Although not separably discernible in FIG. 1, a lift/ladder cord set 39 is seen in a position to support a series of slats 41, and extends through one or more openings (not seen in FIG. 1) in the bottom of the head rail 23. Also seen is an optional crank end 43 which may be used to more rapidly input turning energy into the manual wand 35. The Lift/ladder cord set 39 may be attached at a lower end to a base slat 45 which may be more substantial in weight than any of the series of slats 41 and help to stabilize the stack of slats 41 upon lifting or lowering. Base slat 45 may also have structures to assist in securing and terminating the lower ends of the Lift/ladder cord set 39.

Figure 2:
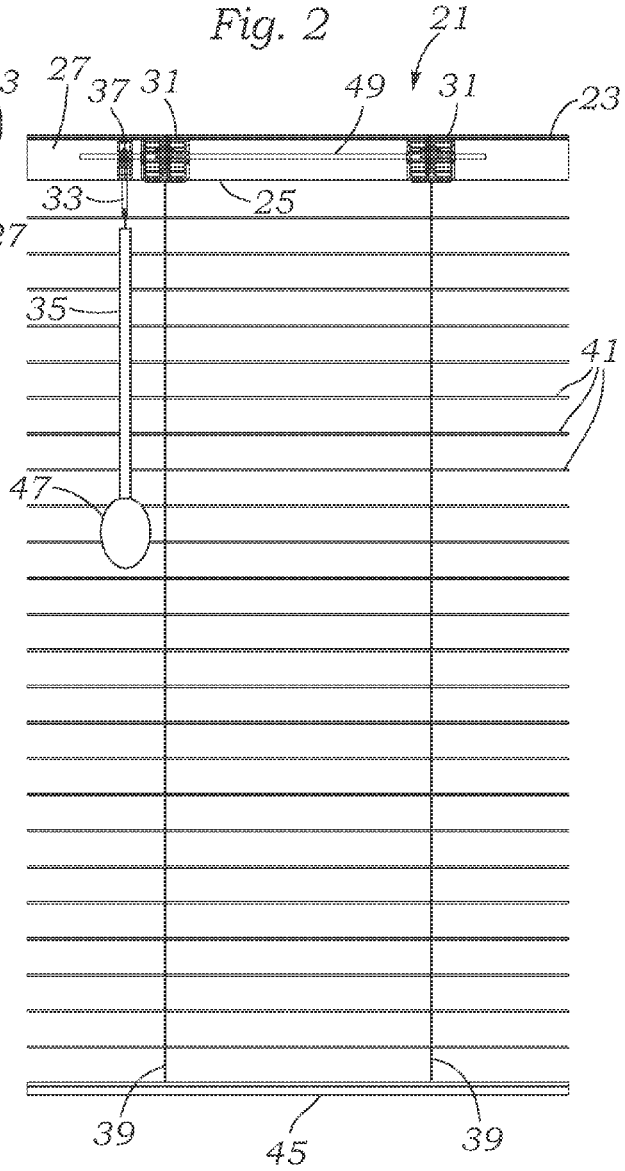
FIG. 2 is a plan sectional view taken along line 2-2 of FIG. 1 and illustrating the spacing and orientation of the combination slat angle adjustment and window covering opening lift sets within the head rail.

Referring to FIG. 2, a plan sectional view of the window covering window blind set 21 taken along line 2-2 of FIG. 1 is seen. FIG. 2 illustrates the spacing and orientation of the combination slat angle adjustment and window covering opening lift sets 31 within the head rail and Illustrates the separation of the reduction gear 37. An optional enlarged end 47 is seen which may be used to more easily input turning energy into the manual wand 35. Also seen is a central turn axle 49 which is connected to the reduction gear 37 and transmits turning force from the reduction gear 37 through the central turn axle 49 and into any number of combination slat angle adjustment and window covering opening lift sets 31, of which two are shown in FIG. 2.

Figure 3:
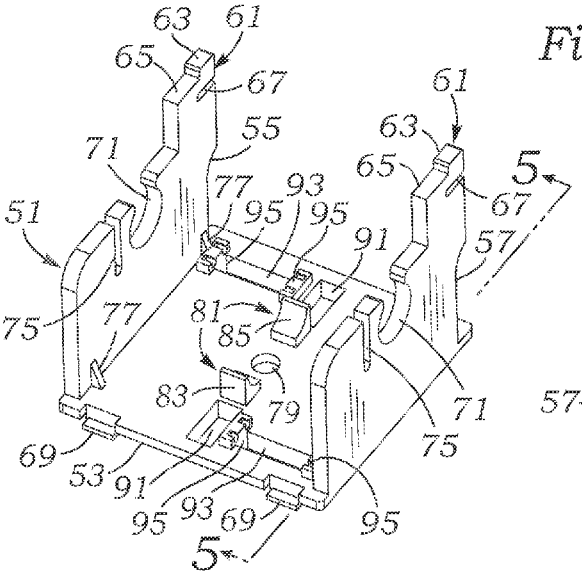
FIG. 3 is a perspective view illustrating the details of a housing support for the combination slat angle adjustment and window covering opening lift sets seen in FIGS. 1 and 2.

Referring to FIG. 3, the details of the combination slat angle adjustment and window covering opening lift sets 31 seen in FIGS. 1 and 2 may be best begun with an explanation of a housing support 51 which is shown in a perspective view. Housing support 51 has a base 53 and a pair of oppositely located side walls 55, 57. In terms of positioning inside the head rail 23, the base 53 fits closely over the head rail 23 base wall 25. The pair of oppositely located side walls 55, 57 have outer surfaces that face in directions parallel to the length of the head rail 25. Between the pair of oppositely located side walls 55, 57 there are no other side walls of housing support 51, with the side walls 27 of the head rail 23 providing some enclosure.

Housing support 51 is typically snap-fitted into the head rail 23, which is typically available in standard sizes, is utilizing the size match and engagement with the downwardly directed top curled metal edge 29. The main holding force for the housing support 51 to secure it within head rail 23 is between uppermost extents 61 of the pair of oppositely located side walls 55, 57 which contain a number of features for interfitting with the downwardly directed top curled metal edge 29 of the head rail 23. An upper projection 63 having a depth in a direction along the side walls 55, 57 which is about the same width between the side wall 27 and downwardly directed top curled metal edge 29. The upper projection rises from a top area 65 of the side walls 55, 57. Underneath the upper projection 63 and top area 65, the side walls 55, 57 contain a flexion relief slot 67 to enable the upper projection 63, and to a lesser extent top area 65 to be pressed down to enable the housing support 51 to be engaged and disengaged from the head rail 23. The opposite point of pressure for the housing support 51 may include a pair of pressure tabs 69 which may be sized to enable some deformation.

The pair of oppositely located side walls 55, 57 each contain an bearing opening 71, having a portion of its inner arced surface formed circularly cylindrical, for receiving a rotational member that will be rotationally supported by the bearing opening 71. Into the side walls 55, 57 adjacent the bearing opening 71, a flexion relief slot 75 to facilitate loading a structure to be bearingly and rotationally supported. Side walls 55, 57 may also have reinforcing structures 77 which increase the area of contact of the side walls 55, 57 with the base 53.

The base 53 of the housing support 51 includes a number of features which contribute to the operation of the combination slat angle adjustment and window covering opening lift sets 31. At the center of the base 53 is an aperture 79 which can be utilized for a number of purposes including marking and alignment as well as for securing the housing support 51 to a head rail 53 if such is needed. In some cases, the aperture 79 may be used for a center lift cord, but inasmuch as the embodiment shown ideally operates with a pair of outside lift cords, the configuration shown will not use the center aperture 79 for passing a single lift cord, and an inside lift cord may either result in a shift of position of the center aperture underneath a take up spool, or an arrangement which would locate a take up spool over the aperture 79. An opening, or openings in the head rail 23 may be had that will enable the individual components of the lift/ladder cord set 39 to enter the head rail 23 either separately or together, are not shown.

Most closely adjacent the apertures 79 are a pair of stops 81. Stops 81 each have a vertical surface 83 facing away from the aperture 79 and a curved surface 85 facing toward aperture. The curved surface 85 transitions from a vertical surface to a near horizontal surface and is meant to make an accommodation space for accommodating a turning member (not yet shown). An abbreviated small surface exists between the uppermost extent of the vertical surface 83 and the uppermost extent of the curved surface 85 to provide a substantial force resisting surface as a stopping index.

The base 53 of the housing support 51 includes four major openings including a pair of tilt cord openings 91 and a pair of lift cord openings 93. The tilt cord openings 91 are located directly on either side of the aperture 79 and each is on the other side of its respective closer stops 81. The tilt cord openings 91 are rectangular with the longer dimension being collinear with each other and also parallel to the plane of the side walls 55, 57. The pair of lift cord openings 93 are rectangular with the longer dimension being perpendicular to the plane of the side walls 55, 57 and parallel but displaced axially from each other. Because pair of lift cord openings 93 are offset from the center, they may preferably have some roller support and wear structures 95, with those wear structures closer to the center of housing support 51 more likely to be subjected to lift cord wear.

Figure 7:
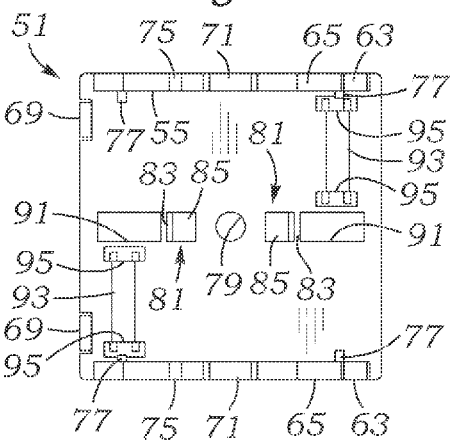
FIG. 7 illustrates a top view of the housing support of FIGS. 3-6.
Figure 6:
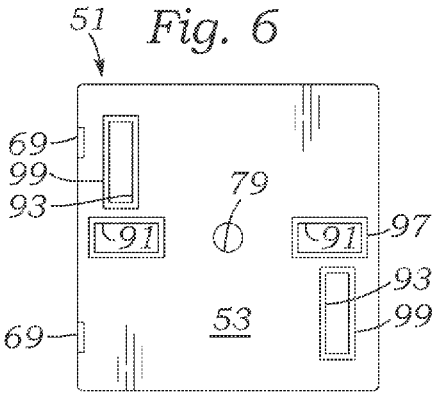
FIG. 6 illustrates a bottom view of the housing support of FIGS. 3-5.
Figure 5:
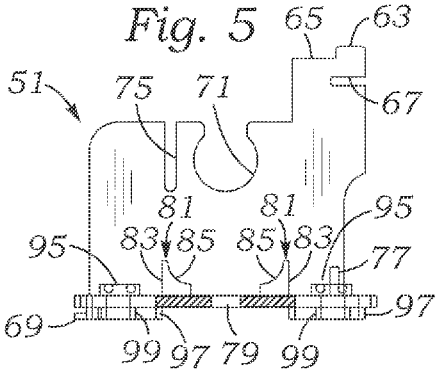
FIG. 5 illustrates a view of the housing support shown in FIGS. 3 and 4 and taken along line 5-5 of FIG. 3 which shows additional lower flanges for providing additional wear area.
Figure 4:
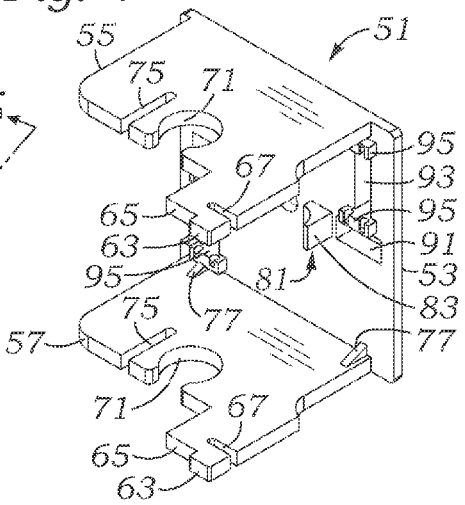
FIG. 4 illustrates a view from the other side of the housing support shown in FIG. 3.

Referring to FIG. 4, a view from the other side of the housing support 51 of FIG. 3 is shown. Referring to FIG. 5, a view taken along line 5-5 of FIG. 3 shows additional details, including a pair of tilt cord flanges 97 and a pair of lift cord flanges 99 both of which provides additional wear area. The roller support and wear structures 95 help to combat wear about the pair of lift cord openings 93 at the top while the pair of lift cord flanges 99 provide additional wear area at the bottom of the housing support 51. Referring to FIG. 7, a top view consistent with the views of FIGS. 3-6 is shown.

Referring to FIG. 7, an exploded view of the components of a mechanical transmission assembly 101 which is operably supported within the housing support 51 of FIGS. 3-7 is shown. At the left side of FIG. 8, a combination first take up spool, bearing, and axle member 103. First take up spool, bearing, and axle member 103 may be constructed as a one piece assembly and includes a first take up spool structure 107 which includes a cylindrical structure 111 axially between a first flange 113 and a second flange 115. Cylindrical structure may contain at least one key slot 117, 119, preferably of different size, to enable quick engagement with the knotted end of a lift cord (not individually shown) portion of the lift/ladder cord set 39. This is helpful to facilitate the assembly process and may represent not only the quickest form of attachment, but also consistency where lift cords may be provided in pre-cut and possibly pre terminated and where the a first take up spool structure 107 position within the housing support 51 may be pre-set in order to achieve a greater precision of the finished window covering window blind set 21.

To the left of the first take up spool, bearing, and axle member 103, and adjacent first take up spool structure 107, a rotational support bearing member 121 is seen. The rotational support bearing member 121 has a surface and radius to match an associated one of the bearing openings 71 of the housing support 51. The rotational support bearing member 121 has a square bore 123 to accept the central turn axle 49 extend completely through the first take up spool, bearing, and axle member 103 and across the housing support 51 to enable the central turn axle 49 to transmit mechanical power among multiple combination slat angle adjustment and window covering opening lift sets 31. The first take up spool structure 107 is shown as having a hub 125, spokes 127 which extend the axial length of the first take up spool structure 107, and connect to the inside 129 of the cylindrical structure 111, although other configurations are possible.

Immediately to the right of the first take up spool structure 107, a slip bearing structure 131 is seen. Slip bearing structure has an outer bearing surface 133. Slip bearing structure 131 is a land which circumferentially arises from an axle member 135. The axle member 135 has a key rib 137. To the right of the axle member 137, a further rotational support bearing member 139 also has a surface and radius to match the other associated one of the bearing openings 71 of the housing support 51. The rotational support bearing member 139 is adjacent the opening of the square bore 123 which cannot be seen in FIG. 8, again to accept the central turn axle 49 extend completely through the first take up spool, bearing, and axle member 103.

To one side of the first take up spool, bearing, and axle member 103, a ladder cord engagement structure is seen as a combination slat tilt fitting and slip fitting housing 141 is seen. The exterior of the slat tilt fitting and slip fitting housing 141 has a pair of oppositely positioned tilt cord supports 143 which extend circumferentially above a generally circular housing 145 both in the interior and exterior. The pair of oppositely positioned tilt cord supports 143 have a split, angled structure 147 which extends from adjacent the generally circular housing 145 at one end and terminate at a split pair of stop engagement structures 149. Beyond the stop engagement structures 149, the tilt cord supports 143 include a gently arced structure 151 which is circumferentially outward of the generally circular housing 145 and include a central groove 155.

The central groove 155 and pair of stop engagement structures 149 help to accommodate and grasp the terminating ends of the vertical ladder cords of the lift/ladder cord set 39. Rotation of the slat tilt fitting and slip fitting housing 141 about the slip bearing structure 131 will cause movement of the front vertical ladder member with respect to the rear vertical ladder member caused a tilting of the horizontal member underneath each slat 41 and consequent tilting of the supported slat 41. The split pair of stop engagement structures 149 help to stabilize a knot or other enlarged structure on a cord, as well as to generally be compatible with the top of pair of stops 81 of the housing support 51. Thus, the slat tilt fitting and slip fitting housing 141 has a range of movement to a position where stop engagement structures 149 on one side of the slat tilt fitting and slip fitting housing 141 contacts one of the pair of stops 81 on its side of the housing support 51, to a position where the stop engagement structures 149 on the other side of the slat tilt fitting and slip fitting housing 141 contacts one of the pair of stops 81 on its side of the housing support 51.

The slat tilt fitting and slip fitting housing 141 has an overall annular face 157 on both sides, and a circumferentially inwardly disposed inside 159 extending between the annular faces 157 and which is sized to support a coiled tension spring 161. Features of the circumferentially inwardly disposed inside 159 include an inside surface 165 into which the coiled tension spring 161 can fit, and an extended portion 167 which accommodates an upper "T" shaped slot 169 for securing and interfitting with generally axially parallel angled ends 171,173 of tension spring 161, each of which depend from a circumferentially outwardly extending transition length 175 (only one of which is seen in the perspective view of FIG. 8). Circumferentially outwardly extending transition length 175 connects the generally axially parallel angled ends 171,173 of coiled tension spring 161 to a coil structure 177.

The coiled tension spring 161 operates differently than most springs used for frictional tension. Usually a friction mounted coil spring grasps a bearing area tightly until an external force urges a slight uncoiling of the spring sufficient to break a coiled grip force. The coiled tension spring 161 of the invention works somewhat in reverse, in that the coiled tension spring 161 is used to apply a slip engagement to the slip bearing structure 131. However, it is the slip bearing structure 131 which is providing an input force to the coiled tension spring 161 while it is secured within the slat tilt fitting and slip fitting housing 141. The description of a structure which can move with another structure but which can provide slippage where the force on a structure such as slat tilt fitting and slip fitting housing 141 can be realized in a wide variety of configurations. Any structure which can move with another structure but which can provide slippage where the force or angular displacement (which will result in limited relative movement of a pair of vertical ladder cords, such as lift ladder cord set 39) has reached a threshold limit can be utilized.

First, the generally axially parallel angled ends 171,173 of tension spring 161 are brought together and made to stably rest within the upper "T" shaped slot 169. Note that the direction of coil of the coil structure 177 is such that when generally axially parallel angled ends 171,173 of coiled tension spring 161 are brought together that the coil structure 177 tightens. The width of the upper "T" shaped slot 169 is of a dimension to exactly determine the degree to which the coil structure 177 contracts. The vertical part of the upper "T" shaped slot 169 is wide enough to facilitate entry of the generally axially parallel angled ends 171,173 and circumferentially outwardly extending transition length 175 of the coiled tension spring 161 into and through the upper "T" shaped slot 169.

Seen to the right of coiled tension spring 161 is a second take up spool structure 191, second take up spool structure 191 includes, as was the case for first take up spool structure 103, a cylindrical structure 111, first flange 113 and a second flange 115, key slot 117, 119, and hub 125. However, the hub 123 includes an axial bore 193 which is sized to fit over axle member 135. Axial bore 193 further includes a key slot 195 which interfits with key rib 137 so that rotational movement of the axle member 135 causes second take up spool structure 191 to turn positively. As such, the second take up spool structure 191 moves along with the first take up spool structure 107 when the second take up spool structure 191 is keyably engaged with the axle member 135.

Figures 8, 9, 10:
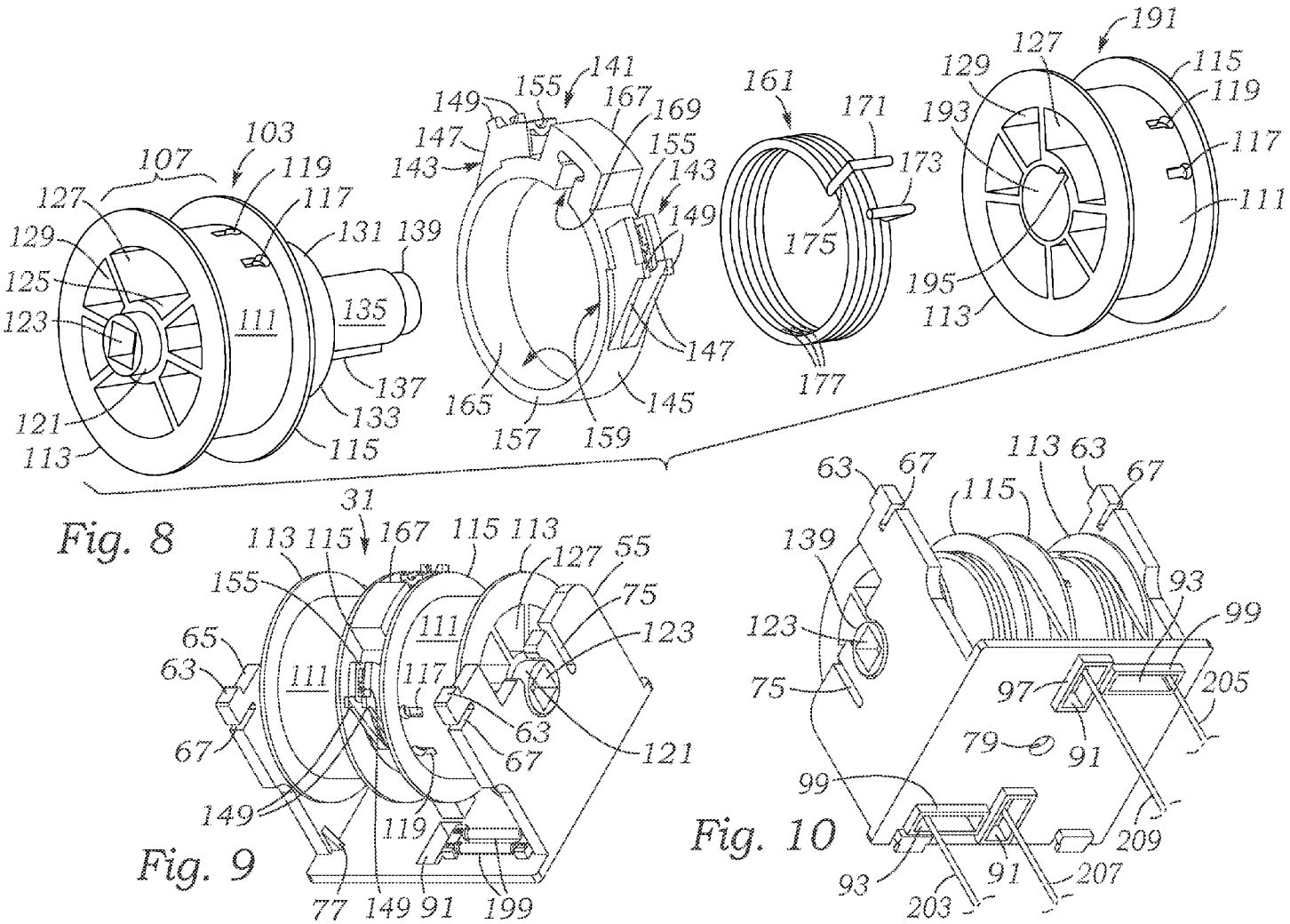
FIG. 8 illustrates an exploded view of a mechanical transmission assembly which is operably supported within the housing support of FIGS. 3-7 and including a pair of take up spool for lift on either side of a slat tilt fitting and reveals the mechanism of the slip fitting used within the slat tilt fitting.
FIG. 9 is an expanded perspective view of a combination slat angle adjustment and window covering opening lift set further illustrating a pair of rollers being supported by the reinforcing roller support and wear structures.
FIG. 10 is an expanded perspective view of a combination slat angle adjustment and window covering opening lift set of FIG. 9, but seen from a bottom point of view with the addition of tilt and lift cords added.

Referring to FIG. 9, an expanded perspective view of a combination slat angle adjustment and window covering opening lift set 31 is seen. In addition to the structures already seen, a pair of rollers 199 are shown as being supported by the reinforcing roller support and wear structures 95. The rollers 99 reduce friction for a lift cord of the lift/ladder cord set 39, while the reinforced roller support structure of the reinforcing roller support and wear structures 95 provides increased wear resistance at the end of each of the pair of lift cord openings 93.

Referring to FIG. 10, an expanded perspective view of a combination slat angle adjustment and window covering opening lift set 31 is seen from a bottom point of view. In addition to the structures already seen, a first lift cord 203 and second lift cord 205 which were previously shown as part of the lift/ladder cord set 39. Also, a first ladder cord 207 is seen and a second ladder cord 209. First ladder cord 207 moves along its length relative to the second ladder cord 209 to tilt the slats 41 seen in FIGS. 1 and 2. Given that first and second ladder cords 207 and 209 will preferably be located directly over the lift/ladder cord set 39, the lift cords 203 and 205 will have to make a transition toward the first and second ladder cords 207 and 209 to become aligned in a short distance.

Figure 11:
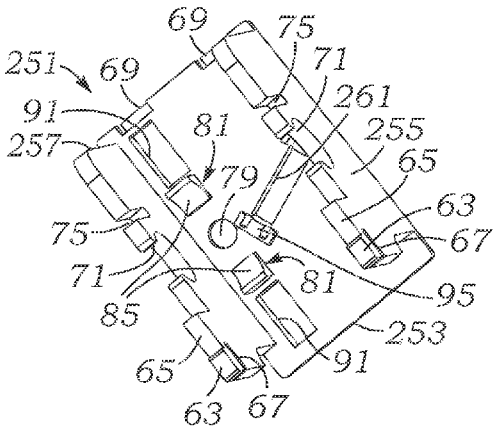
FIG. 11 is a perspective view of a housing support of a second embodiment of the combination slat angle adjustment and window covering opening lift sets which was seen in FIGS. 1-10.

Referring to FIG. 11, a perspective view of a second embodiment of the combination slat angle adjustment and window covering opening lift sets 31 which was seen in FIGS. 1-10. The second embodiment has a single take up drum for use with a single lift cord, with connection either through the centers, or at one sides of the series of slats similar to slats 41. Slats 41, when used with a ladder cord structure having no connection the slats 41, becomes a removable slat system and this was described with respect to FIGS. 1-10. The embodiment of FIG. 11 will ideally actuate a single lift cord.

Many of the structures of the combination slat angle adjustment and window covering opening lift set of the second embodiment and other component structures have common structure with the combination slat angle adjustment and window covering opening lift sets 31 and will be numbered in common. A housing support 251 has a base 253 and a pair of side walls 255 and 257, but side wall 257 is seen as being close to aperture 79. The relationship between aperture 79, pair of stops 81, vertical surface 83, curved surface 85 and pair of tilt cord openings 91 remains the same. Compared to base 53, it is seen that the area of the base 51 of FIG. 3 which was beneath one of the first and second take up spool structures 107 and 191 was been removed, and a side wall that would have been one of the side walls 55, 57 is moved toward the aperture 79 along with removal of one of the pair of lift cord openings 93 that was seen in FIG. 3.

Figure 12:
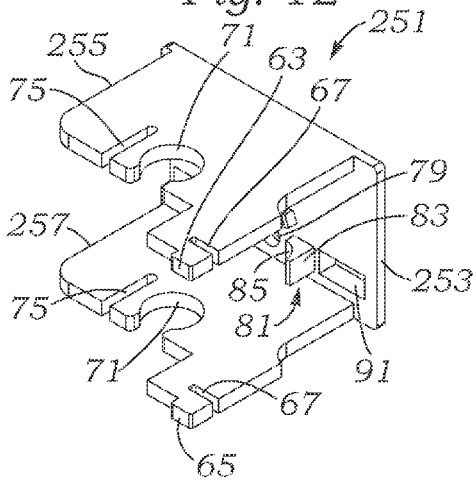
FIG. 12 is a perspective view of the housing support of FIG. 11 shown, from the underside.

The other of the pair of lift cord openings 93 seen in FIGS. 1-10 has had its relationship to the aperture 79 changed, by moving it closer to aperture 79 and angled with respect to the side walls 255 and 257, and is seen as a lift cord opening 261. Lift cord opening 261 is seen without rollers 199. Referring to FIG. 12, a perspective view of the housing support 251 from another angle illustrates that but for lift cord opening 261 having a difference in location and the narrower width and non-bilateral symmetry of the a base 253, the other details of housing support 251 are similar to housing support 51.

Figure 13:
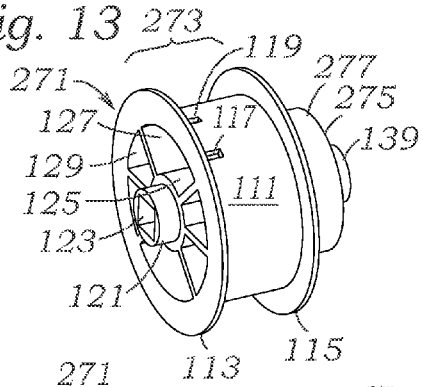
FIG. 13 is a perspective view of a mechanical transmission assembly which can be a combination take up spool and bearing.

Referring to FIG. 13, a mechanical transmission assembly which can be a combination first take up spool and bearing 271, includes a take up spool structure 273 along side a slip bearing structure 275 having an outer bearing surface 277. The structure axle member 135 with its key rib 137 in the first take up spool, bearing, and axle member 103 has been eliminated as these structures are not needed when there is no second take up spool structure 191. Further, the rotational support bearing member 139 is adjacent the slip bearing structure 275. The other structures of FIG. 13 are numbered the same as for first take up spool, bearing, and axle member 103 where they perform the same function.

Figure 14:
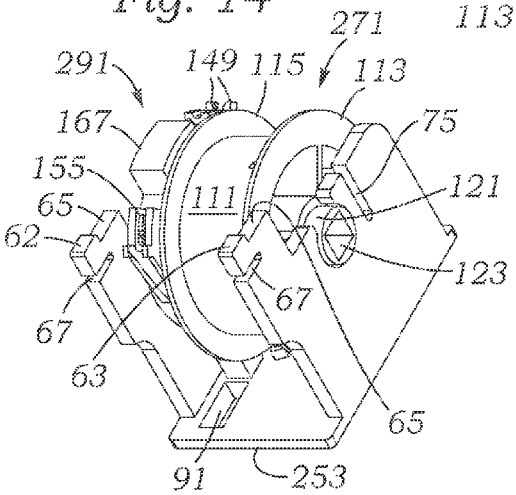
FIG. 14 is an expanded perspective view of an assembled combination slat angle adjustment and window covering opening lift set including the housing support of FIGS. 11 and 12 and the mechanical transmission assembly of FIG. 13.
Figure 15:
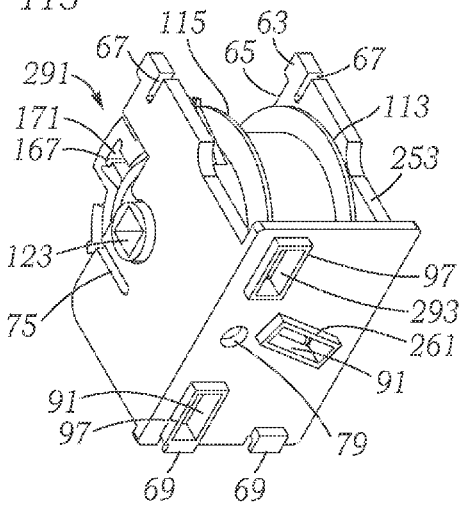
FIG. 15 is an expanded perspective view of the assembled combination slat angle adjustment and window covering opening lift set of FIG. 14 and shown from the underside.

Referring to FIG. 14, an expanded perspective view of a combination slat angle adjustment and window covering opening lift set 291 is seen. A pair of rollers 199 which interfit with the reinforcing roller support and wear structures 95 seen in FIG. 11 are not seen because of the angle and because of the presence of the combination first take up spool and bearing 271. This is an important point out that the orientation of the combination first take up spool and bearing 271 within the combination slat angle adjustment and window covering opening lift set 291 is important to align the slat tilt fitting and slip fitting housing 141 over its pair of tilt cord openings 91, whereas the components of a mechanical transmission assembly 101 seen in FIG. 8 could be aligned in either direction within the housing support 51. Referring to FIG. 15, the expanded perspective view of a combination slat angle adjustment and window covering opening lift set 291 of FIG. 14 is seen from a bottom view. A lift cord flange 293 is seen surrounding the Lift cord opening 261.

Figure 16:
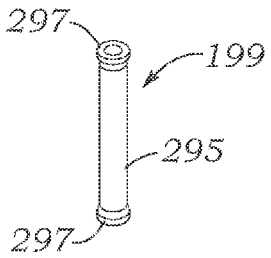
FIG. 16 is a perspective closeup view of a roller which was seen in FIG. 9.

FIG. 16 is a perspective closeup view of a roller 199 which was seen in FIG. 9. Roller 199 may preferably be a hollow annular tube having a main cylindrical extent 295 with each end being expanded into a larger diameter land 297. The reinforcing roller support and wear structures 95 may be configured to provide a snap loading of the roller 199. The use of a roller 199 having snap action will enable the life of the combination slat angle adjustment and window covering opening lift sets 31 and 291 to be extended through repair and replacement of the roller 199.

Figure 17:
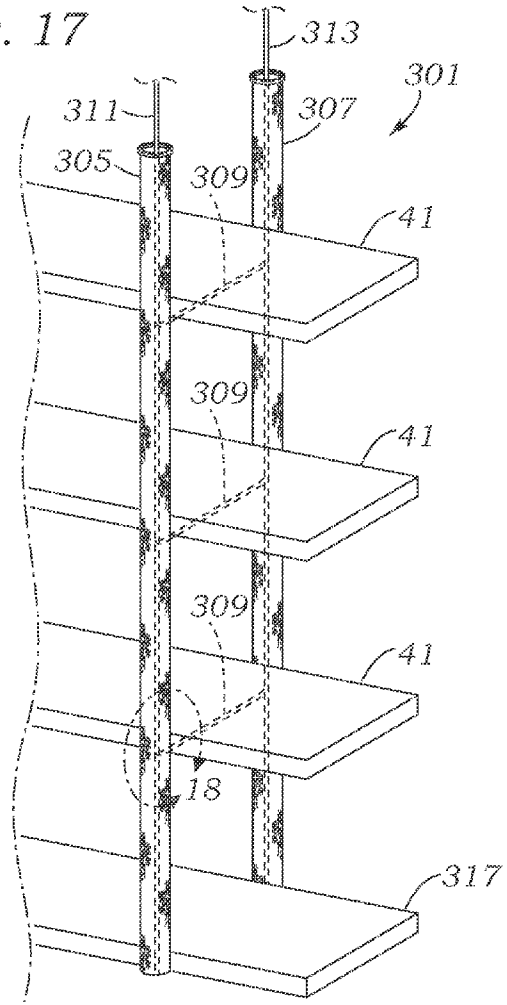
FIG. 17 is a perspective closeup view illustrating a combination tubular vertical ladder cord and annularly contained lift cord set as but one of the embodiments which the lift/ladder cord set utilizable with the combination slat angle adjustment and window covering opening lift set of FIGS. 1-10.

Referring to FIG. 17, a perspective closeup view illustrates a tubular ladder as but one of the embodiments which the lift/ladder cord set 39 can take. Already mentioned is the possible use of a ladder cord set consisting of two main vertical members having a series of generally (horizontal in the untitled position) cross members for supporting slats 41 in an operable but removable manner is already known. Lift cords which can, in an orderly way, provide lift to a bottom slat to enable the slats 41 above it to stack neatly on the bottom-most slat generally require some way to remain closely associated with the horizontal cross members, or with the vertical members at positions close to the horizontal cross members. This close association keeps the stack orderly as the stack is raised to thus open the window covering. One method for keeping close association of the lift cords with the vertical members of the ladder cord is to form a series of loops on the vertical ladder cords through which the lift cord can pass. Even with stops mounted on the manually operated lift cord near the head rail, the lift cord can be pulled out from the vertical lift cord support loops to form a dangerous loop or noose.

Referring to FIG. 17, one possible embodiment is shown as a combination tubular vertical ladder cord and annularly contained lift cord set 301. As can be seen, first tubular vertical ladder cord 305 and a second tubular vertical ladder cord 307 have a series of horizontal connector cords 309. Two slats are seen with the horizontal connector cords 309 shown in phantom. A third horizontal connector cords 309 is shown with the slat 41 removed, both for visual clarity and to emphasize that this embodiment allows the slats to be removed. Slats 41 are plain rectangular thin planks and have no required features for engagement.

Within the first and second tubular vertical ladder cords 305 and 307, a first lift cord 311 and a second lift cord 313, are seen. Lift cords 311 and 313 can be the same as lift cords 203 and 205. First and second tubular vertical ladder cords 305 and 307 can be equivalent to ladder cords 207 and 209 shown engaging the combination slat angle adjustment and window covering opening lift sets 31 as seen in FIGS. 9 and 10. FIG. 17 is shown partially broken at the top so that a shorter vertical segment can be shown more clearly and in an expanded view. A base slat 317, which is typically heavier and thicker than the slats 41, is typically a structure at which an end of the first lift cord 311 and an end of the first tubular vertical ladder cord 305 is terminated and joined together at one side of the base slat 317. Likewise, an end of the second lift cord 313 and an end of the second tubular vertical ladder cord 307 is terminated and joined together at the other side of the base slat 317.

Upward displacement of the first and second lift cords 311 and 313 will cause the base slat 317 to lift upwardly. The weight of the slat 41 nearest the base slat 317 on the horizontal connector cords 309 will cause the segments of the first and second tubular vertical ladder cords 305 and 307 which are between the lowermost slat 41 and the base slat 317 to annularly collapse about their respective first and second lift cords 311 and 313, causing the lowermost slat 41 to stackably collect atop the base slat 317. As the first and second lift cords 311 and 313 continue upward, this causes the base slat 317 to continue to lift upwardly to cause the second lowest slat 41 and the base slat 317 to annularly collapse about their respective first and second lift cords 311 and 313, causing the second lowest slat 41 to stackably collect atop the lowermost slat 41. This action either continues until the window covering window blind set 21 are fully raised or until the user stops the process of opening the window covering window blind set 21 and leaves it partially open. Lowering the first and second lift cords 311 and 313 will cause the process described to reverse, namely that each successive slat 41 will be lifted from the stack and suspended by the horizontal connector cords 309 in a spaced vertical array typical of a window covering window blind set 21.

Given that the process of opening the window covering window blind set 21 involves the collapse of an annular tubular structure instead of the simple relaxation of a segment of ladder cord string between horizontal connector cords 309, the material of the first and second tubular vertical ladder cords 305 and 307 should be selected to be soft and deformable enough to allow the slats 41 to stack. The first and second tubular vertical ladder cords 305 and 307 may be made of thin, synthetic material which will readily deform. Failure of the ladder cord segments to deform will lengthen the effective stack of slats 41 near the head rail when the window covering window blind set 21 is in the open position. Free movement of the first and second lift cords 311 and 313 should also preferably enable the horizontal connector cords 309 to be effectively and sturdily connected between the first and second tubular vertical ladder cords 305 and 307 to give support to the slats 41 in the spaced vertical array position.

This does not mean that the first and second tubular vertical ladder cords 305 and 307 need be longitudinally homogeneous. The length of the first and second tubular vertical ladder cords 305 and 307 may include short distance stiffening reinforcement or placement of fittings at or near the point of support for the horizontal connector cords 309.

Preferably such fittings will facilitate close stacking of slats 41, provide for insulation of any propensity for undue wear near the points of attachment of the horizontal connector cords 309, and provide for some orderly movement of the segments of the first and second tubular vertical ladder cords 305 and 307 into an orderly orientation during stacking of the slats 41 which occurs during opening of the window covering window blind set 21. In some cases segments of the first and second tubular vertical ladder cords 305 and 307 may have an accordion-like partially controlled or planned deformation. With the use of the first and second tubular vertical ladder cord segments 305 and 307, a child cannot "fish out" a segment of either the first or second lift cords 311 and 313 to form a dangerous noose or loop.

Figure 18:
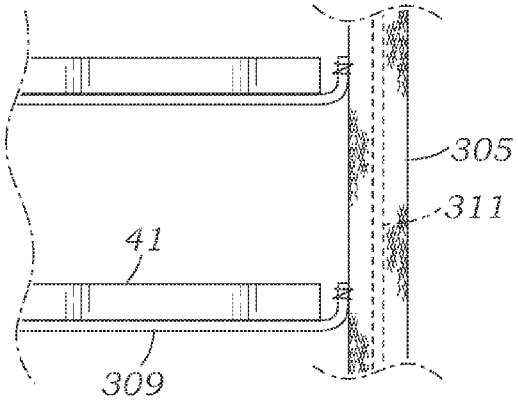
FIG. 18 is an expanded view taken with respect to line 18-18 of FIG. 17 and illustrates some greater detail of the detail of a first tubular vertical ladder cord and horizontal connector cord that can be made to attach to the outside body of the first tubular vertical ladder cord with or without the use of a more invasive connection, or fitting.

Referring to FIG. 18, an expanded view taken with respect to line 18-18 of FIG. 17 and illustrates some greater detail of the detail of the first tubular vertical ladder cord 305 and horizontal connector cord 309. The horizontal connector cord 309 can be made to attach to the outside body of the first tubular vertical ladder cord 305, with or without the use of a more invasive connection, or fitting. The horizontal connector cord 309 can be glued, welded, stitched and attached to the first tubular vertical ladder cord 305 in any manner which is consistent with the materials used for those structures. Slats 41 are seen as being supported by the horizontal connector cord 309.

Figure 19:
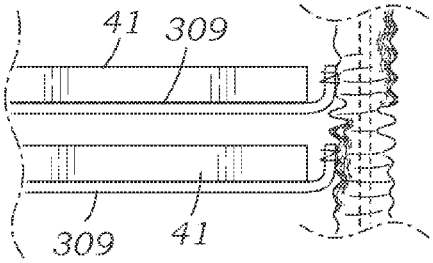
FIG. 19 is an expanded view similar to that shown in FIG. 18 but in a collapsed orientation where the window covering window blind set is being opened and the adjacent slats are stacked in close proximity to each other.

Referring to FIG. 19, an expanded view as in FIG. 18 is illustrated, but in a collapsed orientation where the window covering window blind set 21 is being opened and the adjacent slats 41 are stacked in close proximity to each other. The horizontal connector cord 309 is shown being sandwiched in between two adjacent slats 41. The first tubular vertical ladder cord 305 is being shown as accordioned and compressed at the junction between pairs of connections of the horizontal connector cord 309 to the tubular vertical ladder cord 305. The tubular vertical ladder cords 305 and 307 can be made of a thin, sheer material sufficient only to encase the respective first or second lift cords 311 and 313, such as a nylon sheath or the like. In other cases the tubular vertical ladder cords 305 and 307 can be pre-shaped to compressibly fold in an orderly fashion.

Figure 20:
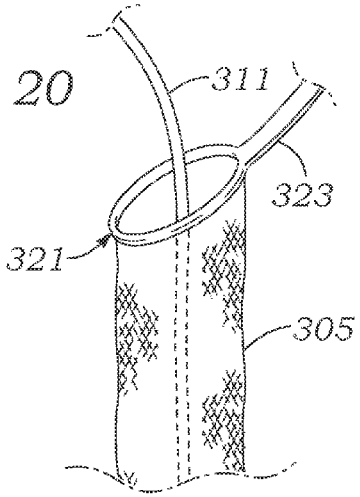
FIG. 20 illustrates one possibility for termination of the ladder cord upper end using a heterogeneous tubular vertical ladder cord where the upper part of the tubular vertical ladder cord is different above the exit point of the lift cord 311 and illustrates a reinforced material about the exit point.

The manner of supporting the first and second tubular vertical ladder cord 305 and 307 at the top of the window covering window blind set 21 near or within the head rail 23 can be performed in a number of ways. Referring to FIG. 20, the upper end of the first tubular vertical ladder cord 305 includes a wear structure 321 at the point where the first lift cord 311 emerges from and extends away from the first tubular vertical ladder cord 305. The wear structure 321 may or may not be made of the same material as the first tubular vertical ladder cord 305. Above the wear structure 321, a length of material 323 is shown. Length of material 323 may or may not be made of the same material as the first tubular vertical ladder cord 305. Both the wear structure 321 and the length of material 323 may be formed by melting and/or fusion of the material of the first tubular vertical ladder cord 305.

The overall idea to be emphasized is that where the physical separation of the first lift cord 311 and first tubular vertical ladder cord 305 is expected to occur a few centimeters below the head rail 23, so that the combination slat angle adjustment and window covering opening lift set 31, 231 will have any lift cord (such as lift cords 203, 205, 311, or 313 or other lift cords which may be shown below), separate and apart from any ladder cord (such as the ladder cord 207, 209, 305, 307, or other ladder cords which may be shown below), supplied to such combination slat angle adjustment and window covering opening lift set 31, 231 in a separated manner. Such separation of any lift cord and any ladder cord can be configured to occur within head rail 23.

Figure 21:
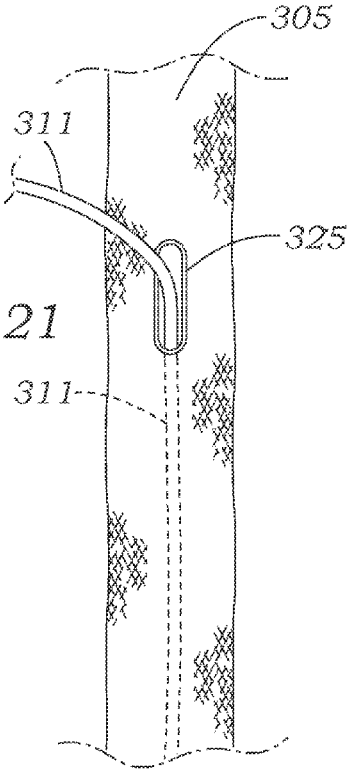
FIG. 21 illustrates another possibility for termination of the ladder cord upper end using a reinforced opening or other structure for supporting the tubular vertical ladder cord independently from the encased lift cord.

Referring to FIG. 21, another possibility for enabling separation of the first or second lift cords 311 and 313 from their respective first and second tubular vertical ladder cords 305 and 307 is shown. The first tubular vertical ladder cord 305 is shown as having a reinforced lift cord exit 325. The type of reinforcement for the reinforced lift cord exit 325 will depend upon the materials from which the first and second tubular vertical ladder cords 305 and 307 are constructed. In some cases the reinforced lift cord exit 325 can be formed by thickening of the material used to form the lift cord exit 325 and in other cases by the addition of a structure to stabilize the lift cord exit 325.

Figure 22:
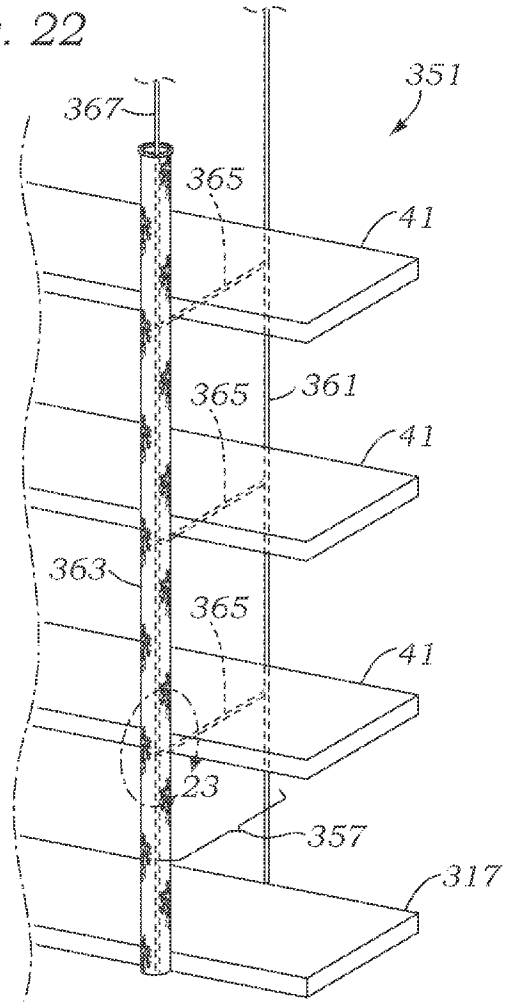
FIG. 22 illustrates a perspective closeup view illustrating a one sided, preferably rear located tubular vertical ladder cord of a hybrid ladder cord set which can be utilized with the combination slat angle adjustment and window covering opening lift set of FIGS. 11-15.

Referring to FIG. 22, a perspective closeup view illustrating a one sided, preferably rear, attachment ladder window covering window blind set 351 which can be utilized with the combination slat angle adjustment and window covering opening lift set 291 of FIGS. 11-15. In the case of window blind set 351, the lifting force will occur on only one lateral side at a long edge of a number of slats 353 by utilizing some holding structure in the slats 353 (not readily seen in FIG. 22). A hybrid ladder cord set 357 includes a front vertical ladder cord 361 and a rear tubular vertical ladder cord 363, periodically connected with sets of horizontal connector cords 365. A lift cord 367 extends through the rear tubular vertical ladder cord 363, but detours out of the rear tubular vertical ladder cord 363 and into and through an opening (not shown in FIG. 22) in each of the slats 353 before returning to a position within the rear tubular vertical ladder cord 363. Lift cords 311 and 313 can be the same as lift cords 203 and 205. Front vertical ladder cord 361 can be equivalent to ladder cord 207 and a rear tubular vertical ladder cord 363 can be equivalent to ladder cords 209, and lift cord 367 can be equivalent to one of the lift cords 205 shown engaging the combination slat angle adjustment and window covering opening lift sets 31 as seen in FIGS. 9 and 10, and which engage the combination slat angle adjustment and window covering opening lift set 291 of FIGS. 11-15.

Figure 23:
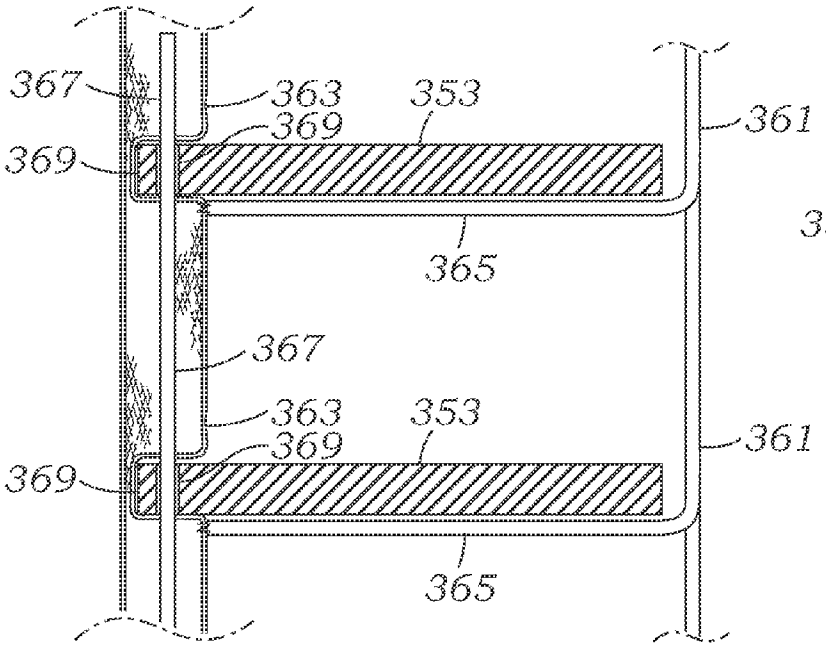
FIG. 23 is a closeup semi sectional side view taken along line 23-23 of FIG. 22 to illustrate one embodiment of the manner of connection of the hybrid ladder cord set utilizing apertures in the slats shown.

Referring to FIG. 23, a closeup semi sectional side view taken along line 23-23 of FIG. 22 is shown. An aperture 369 is located near a rear edge 369 of the slats 353. At the level of each slat 353, a break in the rear tubular vertical ladder cord 363 occurs sufficient to enable the lift cord 367 to extend out of the rear tubular vertical ladder cord 363 and into and through the aperture 369 is located near a rear edge 369 of the slats 353, and then back into the break in the rear tubular vertical ladder cord 363 to enable the lift cord 369 to continue its travel within the rear tubular vertical ladder cord 363 until it comes to the level of the next slat 353. The manner and the degree to which break in the rear tubular vertical ladder cord 363 occurs can vary widely and may depend upon the material of construction for the rear tubular vertical ladder cord 363. Where the break in the rear tubular vertical ladder cord 363 is extremely flexible and soft, the lift cord 367 may only briefly leave cover of the rear tubular vertical ladder cord 363. Where the rear tubular vertical ladder cord 363 is more rigid, a larger tubular diameter of rear tubular vertical ladder cord 363 may be provided and/or a greater sized break in the rear tubular vertical ladder cord 363 may be provided to enable the lift cord 367 to easily approach and slidably pass through the aperture 369 is located near a rear edge 369 of the slats 353.

Figure 24:
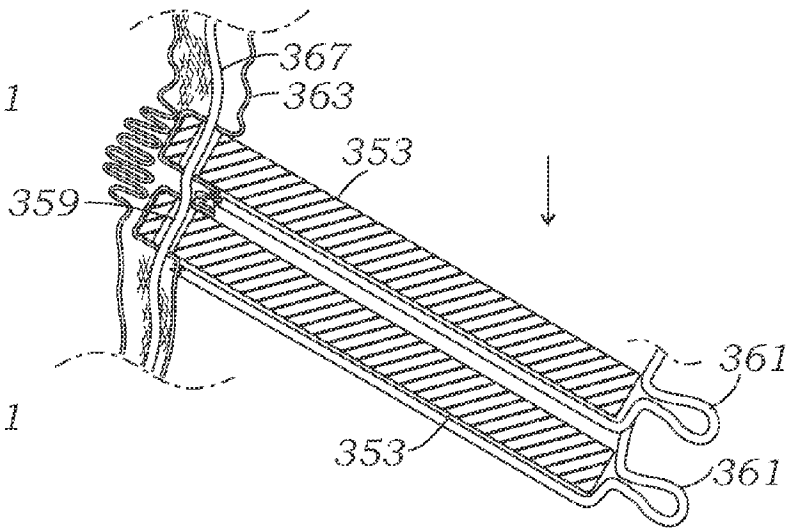
FIG. 24 illustrates a closeup semi sectional side view as was shown in FIG. 23 but with the slats in a more closely aligned stack position as they would be upon raising of the lift cord to open the window covering blind set with which the hybrid ladder cord set is associated.

Referring to FIG. 24, a closeup semi sectional side view as was shown in FIG. 23 is illustrated, but with the slats in a more closely aligned stack position as they would be upon raising of the lift cord 367 to open the window covering blind set 351 with which the hybrid ladder cord set 357 is associated. Note that the stack of slats 353 (only two are shown) are tilted as are lifted from one side and will likely maintain an angled stack throughout the process of opening of the window covering blind set 351.

While the present invention has been described in terms of a system and method which facilitates bi-directional single control input which can be utilized for both slat tilting adjustment as well as for raising and lowering the slats of a window covering, one skilled in the art will realize that the structure and techniques of the present invention can be applied to many structures, including any structure or technique where the actuation force and control input is preferably limited to a single structure located at a single point of input and where cords and lines are to be kept away from inadvertent contact with children and pets.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A combination slat angle adjustment and window covering opening lift set comprising:

a housing support having a first and second bearing opening; and, a mechanical transmission assembly including:

a first bearing member for supported rotation within the first bearing opening of the housing support;

a first spool rotatable with the first bearing member for engaging a first lift cord;

a ladder cord engagement structure adjacent the first spool and having a slip fitting housing rotationally engaging a coil tension spring having ends captured closely to each other for providing fixed coil slip movement with respect to a slip bearing structure portion of the first spool, the ladder cord engagement structure for moving vertical ladder cords relative to each other along their axial length within a limited relative movement of the first spool;

a second spool adjacent the ladder cord engagement structure for engaging a second lift cord;

a second bearing member for supported rotation within the second bearing opening of the housing support, the first bearing member, first spool, second spool and second bearing member being rotatably fixed with respect to one another.

2. The combination slat angle adjustment and window covering opening lift set as recited in claim 1 wherein the coil tension spring ends engaged by the slip fitting housing are captured in a position to inhibit a loosening of the coil.

3. The combination slat angle adjustment and window covering opening lift set as recited in claim 1 and further comprising a central turn axle engaging the mechanical transmission assembly for inputting mechanical turning movement.

4. The combination slat angle adjustment and window covering opening lift set as recited in claim 3 wherein the central turn axle extends completely through the mechanical transmission assembly.

5. The combination slat angle adjustment and window covering opening lift set as recited in claim 3 and further comprising a reduction gear engaging the central turn axle for facilitating the input of mechanical turning movement into the mechanical transmission assembly.

6. The combination slat angle adjustment and window covering opening lift set as recited in claim 1 wherein the housing support is configured to fit within a head rail.

7. The combination slat angle adjustment and window covering opening lift set as recited in claim 1 and further comprising a lift and ladder cord set that further comprises:

a first hollow annular tube engaging the ladder cord engagement structure;

a second hollow annular tube engaging the ladder cord engagement structure;

a plurality of connector cords connected between the first and the second hollow annular tubes, the attachment of the first and second hollow annular tubes to the slip fitting housing to enable the first hollow annular tube can be moved relative to the second hollow annular tube to affect an angular relationship of the plurality of connector cords for adjusting an angle of any slats supported by the plurality of connector cords;

a first lift cord extending into the first hollow annular tube and attached to the first spool; and a second lift cord extending into the second hollow annular tube and attached to the second spool.

8. The combination slat angle adjustment and window covering opening lift set as recited in claim 1 further comprising a keyed axle member attached to the first spool, and wherein the second spool has an axial bore with a key slot engaged with the keyed axle member.

9. The combination slat angle adjustment and window covering opening lift set as recited in claim 1 wherein the housing support includes at least one of a tilt cord opening and a ladder cord opening.

10. A combination slat angle adjustment and window covering opening lift set comprising:

a housing support having a first and second of bearing opening; and, a mechanical transmission assembly including:

a first bearing member for supported rotation within the first bearing opening of the housing support;

a spool rotatable with the first bearing member for engaging a lift cord;

a ladder cord engagement structure adjacent the spool and having a slip fitting housing rotationally engaging a coil tension spring having ends captured closely to each other for providing fixed coil slip movement with respect to a slip bearing structure portion of the spool, the ladder cord engagement structure for moving vertical ladder cords relative to each other along their axial length within a limited relative movement of the spool; and a second bearing member for supported rotation within the second bearing opening of the housing support, the first bearing member, spool, and second bearing member being rotatably fixed.

11. The combination slat angle adjustment and window covering opening lift set as recited in claim 10 wherein the coil tension spring ends engaged by the slip fitting housing are captured in a position to inhibit a loosening of the coil.

12. The combination slat angle adjustment and window covering opening lift set as recited in claim 10 and further comprising a central turn axle engaging the mechanical transmission assembly for inputting mechanical turning movement.

13. The combination slat angle adjustment and window covering opening lift set as recited in claim 12 and further comprising a reduction gear engaging the central turn axle for facilitating the input of mechanical turning movement into the mechanical transmission assembly.

14. The combination slat angle adjustment and window covering opening lift set as recited in claim 10 wherein the housing support is configured to fit within a head rail.

15. The combination slat angle adjustment and window covering opening lift set as recited in claim 10 and further comprising a lift and ladder cord set that further comprises:

a hollow annular tube for engaging the slip fitting housing;

a vertical ladder cord for engaging the slip fitting housing;

a plurality of connector cords connected between the hollow annular tube and the vertical ladder cord, relative longitudinal displacement between the hollow annular tube and the vertical ladder cord to enable the hollow annular tube to be moved relative to the vertical ladder cord to affect an angular relationship of the plurality of connector cords for adjusting an angle of any slats supported by the plurality of connector cords; and a lift cord extending into the hollow annular tube.

16. The combination slat angle adjustment and window covering opening lift set as recited in claim 10 wherein the housing support includes at least one of a tilt cord opening and a ladder cord opening.

17. A lift and ladder cord set further comprising:

a first hollow annular tube for engaging a first control structure;

a second hollow annular tube for engaging a second control structure;

a plurality of connector cords connected between the first and the second hollow annular tubes for supporting slats between the first and the second hollow annular tubes, relative longitudinal displacement between the first and second hollow annular tubes to enable the first hollow annular tube can be moved relative to the second hollow annular tube to affect an angular relationship of the plurality of connector cords for adjusting an angle of any of the slats supported by the plurality of connector cords;

a first lift cord extending into the first hollow annular tube; and a second lift cord extending into the second hollow annular tube.

18. A lift and ladder cord set further comprising:

a hollow annular tube for engaging a first control structure, the hollow annular tube having a plurality of spaced openings for partially surrounding an associated one of a series of corresponding slats;

a vertical ladder cord for engaging a second control structure;

a plurality of connector cords connected between the hollow annular tube and the vertical ladder cord, relative longitudinal displacement between the hollow annular tube and the vertical ladder cord to enable the hollow annular tube to be moved relative to the vertical ladder cord to affect an angular relationship of the plurality of connector cords for adjusting an angle of any slats supported by the plurality of connector cords; and a first lift cord extending into the hollow annular tube for engagement of the series of corresponding slats at the plurality of spaced openings of the hollow annular tube.

* * * * *